US008072400B2

(12) United States Patent
Mizukoshi et al.

(10) Patent No.: US 8,072,400 B2
(45) Date of Patent: Dec. 6, 2011

(54) MEASUREMENT OF PIXEL CURRENT IN DISPLAY DEVICE

(75) Inventors: Seiichi Mizukoshi, Kanagawa (JP); Makoto Kohno, Kanagawa (JP); Kouichi Onomura, Yokohama (JP); Kazuyoshi Kawabe, Yokohama (JP)

(73) Assignee: Global Oled Technology LLC, Wilmington, DE (US)

( * ) Notice: Subject to any disclaimer, the term of this patent is extended or adjusted under 35 U.S.C. 154(b) by 372 days.

(21) Appl. No.: 12/330,537

(22) Filed: Dec. 9, 2008

(65) Prior Publication Data

US 2009/0160742 A1 Jun. 25, 2009

(30) Foreign Application Priority Data

Dec. 21, 2007 (JP) ..... 2007-330797

(51) Int. Cl.
*G09G 3/30* (2006.01)

(52) U.S. Cl. ..... 345/77; 345/82

(58) Field of Classification Search ..... 345/76–83, 345/204–215

See application file for complete search history.

(56) References Cited

U.S. PATENT DOCUMENTS

| | | | | |
|---|---|---|---|---|
| 6,518,962 | B2 | 2/2003 | Kimura et al. | |
| 6,633,135 | B2 | 10/2003 | Nara et al. | |
| 7,199,602 | B2 | 4/2007 | Nara et al. | |
| 7,345,660 | B2 | 3/2008 | Mizukoshi et al. | |
| 2007/0210996 | A1 | 9/2007 | Mizukoshi et al. | |
| 2008/0238834 | A1 * | 10/2008 | Matsuo et al. | 345/76 |
| 2009/0207106 | A1 * | 8/2009 | Mizukoshi et al. | 345/76 |

* cited by examiner

*Primary Examiner* — Vijay Shankar

(74) *Attorney, Agent, or Firm* — McKenna Long & Aldridge LLP

(57) ABSTRACT

During image display, pixel current measurement for brightness irregularity correction is carried out. Display is carried out by sequentially writing pixel data in a horizontal direction to pixel sections that are arranged in a matrix shape. Horizontal power supply lines PVDD are arranged for each horizontal line, and power is supplied from these power supply lines to corresponding pixel sections. When carrying out measurement of pixel current by lighting pixel sections one at a time, a horizontal power supply line PVDD of a horizontal line to which the lit pixel belongs is connected to a power supply PVDDb by a switch, and other horizontal power supply lines PVDD are connected to PVDDa.

10 Claims, 16 Drawing Sheets

MEASUREMENT OF PIXEL CURRENT IN DISPLAY DEVICE

CROSS-REFERENCE TO RELATED APPLICATION

This application claims priority of Japanese Patent Application No. 2007-330797 filed Dec. 21, 2007 which is incorporated herein by reference in its entirety.

FIELD OF THE INVENTION

The present invention relates to a display device for writing pixel data for each pixel arranged in a matrix shape, and performing display.

BACKGROUND OF THE INVENTION

FIG. 1 shows the structure of a circuit for one pixel section (pixel circuit) of a basic active organic EL display device, and FIG. 2 shows the structure, and input signals of, a display panel.

A data signal is written to a storage capacitor C by setting a gate line (Gate) that extends in the horizontal direction to a high level to turn an n-channel selection TFT 2 on, and in this state placing a data signal (image data) having a voltage corresponding to a display brightness on a data line (Data) that extends in the vertical direction. In this way, a gate of a p-channel drive TFT 1 is set to a voltage corresponding to the data signal, drive current corresponding to the data signal is supplied to the organic EL element 3, and the organic EL element 3 emits light.

Pixel data, a horizontal sync signal (HD), a pixel clock and other drive signals are supplied to a source driver 10. The pixel data signal is sent to the source driver 10 in synchronism with the pixel clock, held in an internal latch circuit once a single horizontal line of pixels have been acquired, and subjected to D/A conversion all at once to supply to a data line (Data) of a corresponding column. Also, the horizontal sync signal (HD), other drive signals and a vertical sync signal (VD) are supplied to a gate driver 12. The gate driver 12 performs control to sequentially turn on gate lines (Gate) arranged horizontally along each line, so that image data is supplied to pixels of the corresponding line. The pixel circuit of FIG. 1 is provided in the pixel sections 14 that are arranged in a matrix shape. Also, a power supply line PVDD is arranged in the vertical direction along a pixel row, and CV is connected to a power supply CV with anodes of the organic EL element provided common to all pixels.

As a result of this type of structure, data are sequentially written to each pixel in horizontal line units, and display is carried out at each pixel in accordance with the written data, to perform image display as a panel.

Here the amount of light emission and current of the organic EL element 3 are in a substantially proportional relationship. Normally, a voltage (Vth) is supplied across the gate of the drive TFT 1 and PVdd such that a drain current approaching that for a black level of the pixel starts to flow. Also, the amplitude of the image signal is an amplitude so as to give a prescribed brightness close to a white level.

FIG. 3 shows a relationship for current "CV current "(corresponding to brightness) flowing in the organic EL element with respect to input signal voltage (voltage of the data line Data) of the drive TFT 1. It is possible to carry out appropriate gradation control for the organic EL element by determining the data signal so that Vb is supplied as the black level voltage and Vw is supplied as the white level voltage.

Specifically, the brightness when the pixel is driven at a particular voltage differs depending on the threshold voltage (Vth) of the drive TFT, and an input voltage close to PVdd (power supply voltage)−Vth (threshold voltage) corresponds to a signal voltage when displaying black. Also, the slope (μ) of the V-I curve of a TFT varies in a similar manner, and in this case, as shown in FIG. 4, an input amplitude (Vp−p) for outputting the same brightness is also different.

If there are variations in Vth and μ of the TFT inside the panel, there will usually be inconsistencies in brightness. With the objective of correcting these brightness inconsistencies, panel current flowing when lighting up each pixel at a number of signal levels is measured, to obtain a V-I curve for individual TFTs.

The related art suffers from the following problems.

1) According to the prior art, image current is measured in real time during image display. In order to suppress effects of aging of the drive TFTs and organic EL elements, it is necessary to measure the current of each particular specified pixel independently. However, during image display, current corresponding to a display image constantly flows in from a power supply, which shows that it is difficult to measure current of a particular specified pixel by measuring power supply current of the panel.

2) FIG. 1 is one example of a pixel circuit, but in actual fact, as shown in FIG. 5, there are distributed constant circuits on each power supply line and signal line due to wiring resistance and stray capacitance etc. Specifically, there are RC distributed constant circuits in the data lines Data between the source driver 10 and the drain of the select TFT 2, in the gate lines Gate between the gate driver 12 and the gate of the select TFT 2, in the power supply lines between the power supply PVDD and the source of the drive TFT 1, and between the cathodes of the organic EL element 3 and the power supply CV.

Therefore, in the event that a voltage is supplied from outside in order to measure PVDD or CV current, the measurement current gradually increases. Accordingly, it is necessary to perform measurement of current with current at a sufficient level of stability, but the fastest measurement time is determined by this, and a comparatively long time is taken to measure one pixel current. A relationship between current Id flowing in the organic EL element and the current Ipvdd flowing from the power supply PVDD to the drive TFT is shown in FIG. 7. In this way it takes a longer time for current Ipvdd to become stable compared to Id. CV current is also subject to the effects of the distributed constant circuits and can be considered to vary similarly to Ipvdd.

3) Only a single pixel is lit at the time of current measurement, but a very small leakage current also flows in pixels that are not lit. Leakage current is generally extremely small, but since leakage currents for a number of pixels (the number of panel pixels−1) are summed, it becomes a value that cannot be ignored. In particular, in the event that leakage current varies over time, it constitutes a noise component, which shows that measurement accuracy will be affected.

SUMMARY OF THE INVENTION

The present invention is directed to an active matrix type display device, for carrying out display by sequentially writing pixel data in a horizontal direction to pixels that are arranged in a matrix shape, including horizontal power supply lines, arranged on each horizontal line, for supplying power to pixels of a corresponding horizontal line, and switches for selecting and connecting each horizontal power supply line to one of two power supplies, wherein pixel current for pixels of one horizontal line is measured by lighting a single pixel, and at that time, a horizontal power supply line of a horizontal line to which the lit pixel belongs is connected to a power supply that is different to that of other horizontal power supply lines.

Gate select lines, can be arranged on each horizontal line, for performing write control of pixel data to pixels of a corresponding line, and when a gate select line for a particular horizontal line is on, measurement of pixel current is carried out by writing data for measurement before writing of pixel data to the pixels.

Measurement of pixel current can be carried out sequentially for pixels of random positions within pixels on each line for which measurement has not yet been carried out.

The present invention also relates to a pixel current measurement method for an active matrix type display device, for carrying out display by sequentially writing pixel data to pixels that are arranged in a matrix shape, wherein A/D conversion output values for pixel current at the time of lighting of a pixel are observed, and feedback control is carried out so as to provide an offset voltage to the input of an A/D converter so that the output values are in a particular range, while a difference between A/D conversion output values when a pixel is unlit and when a pixel is lit is calculated to give pixel current.

According to the present invention, PVDD lines other than horizontal line to which a pixel being measured belongs are isolated, which shows that it is possible to eliminate pixel current that includes leakage current when the other lines are unlit, and parasitic capacitance of the PVDD line (capacitive component of the distributed constant circuit 3 shown in FIG. 5) is reduced, speeding up the rise time of pixel current flowing to the power supply. Also, according to this method, it is possible to perform measurement of pixel current while carrying out normal image display. This shows that it is possible to measure pixel current during image display and correct brightness irregularities. It is also possible to perform accurate pixel current measurement from comparison at the time of illumination and non-illumination.

DETAILED DESCRIPTION OF THE INVENTION

Embodiments of the present invention will be described in the following based on the drawings.

Figure 1:
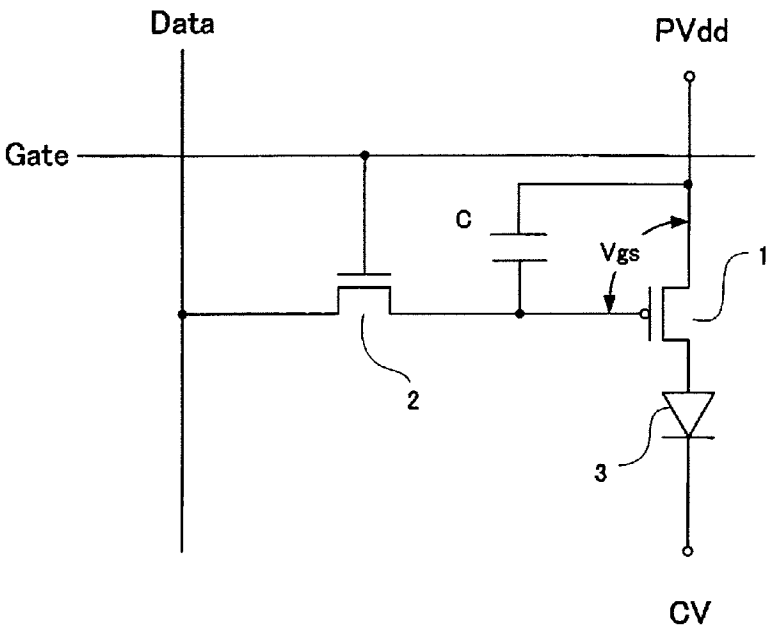
FIG. 1 PRIOR ART
FIG. 1 is a drawing showing a structural example of a pixel circuit.
Figure 2:
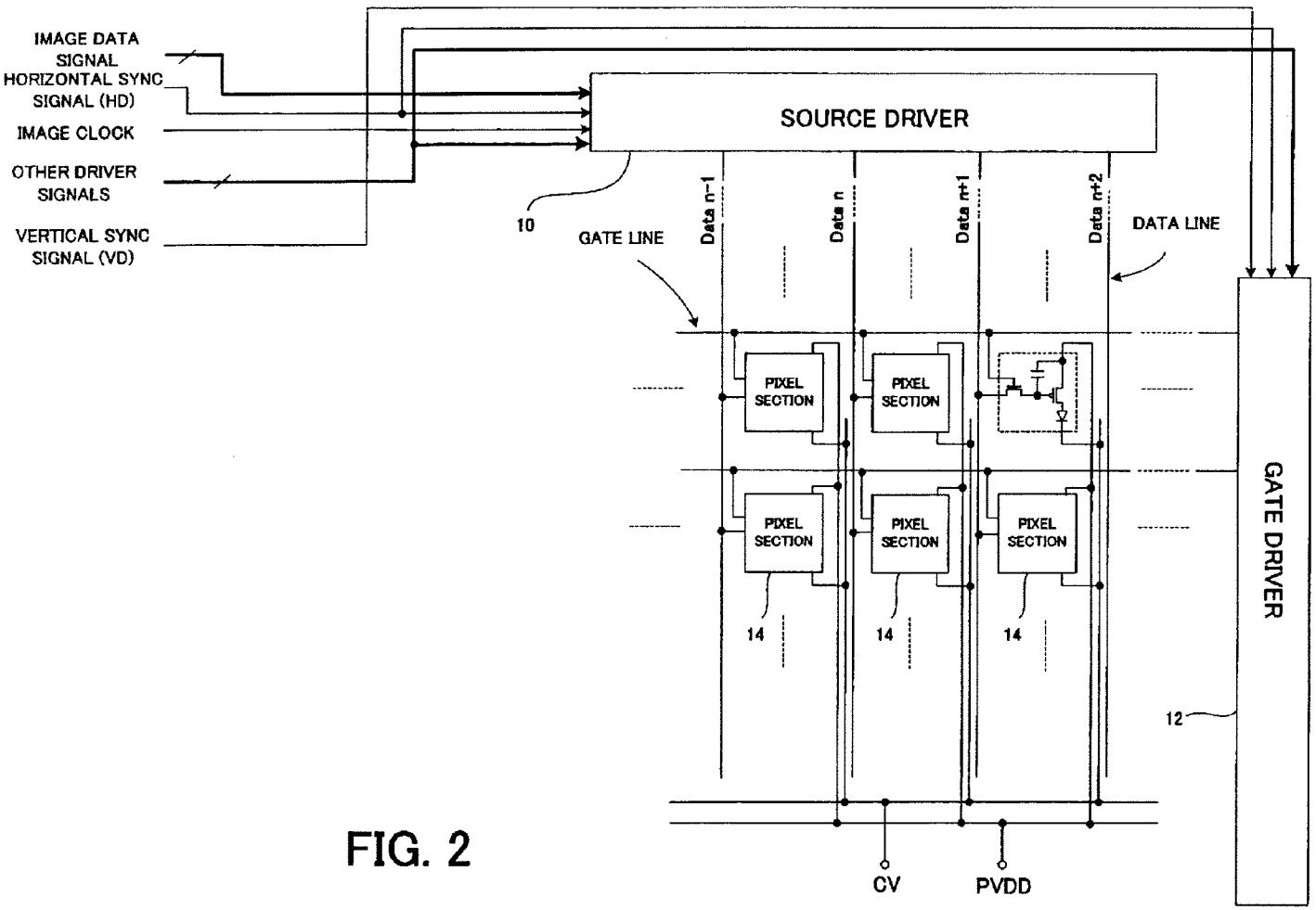
FIG. 2 PRIOR ART
FIG. 2 is a drawing showing a structural example of a display panel.
Figure 3:
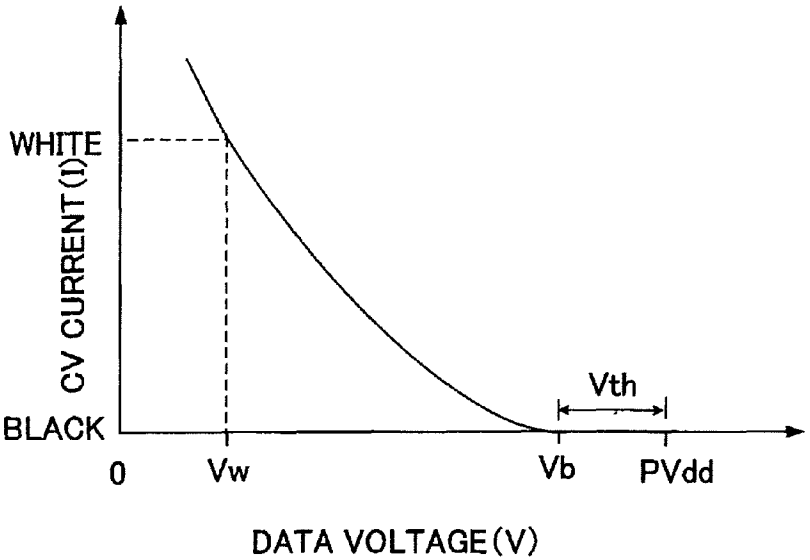
FIG. 3 PRIOR ART
FIG. 3 is a drawing showing a relationship between data voltage and pixel current.
Figure 4:
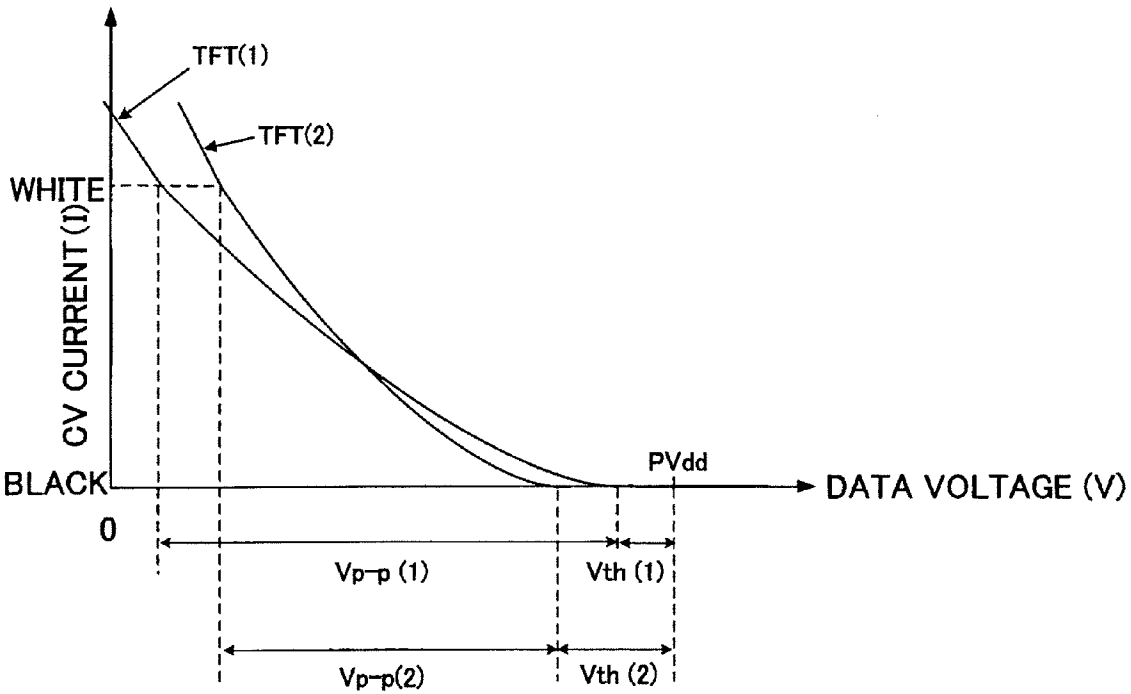
FIG. 4 PRIOR ART
FIG. 4 is a drawing showing a relationship applied voltage and current for two drive TFTs having different characteristics.
Figure 5:
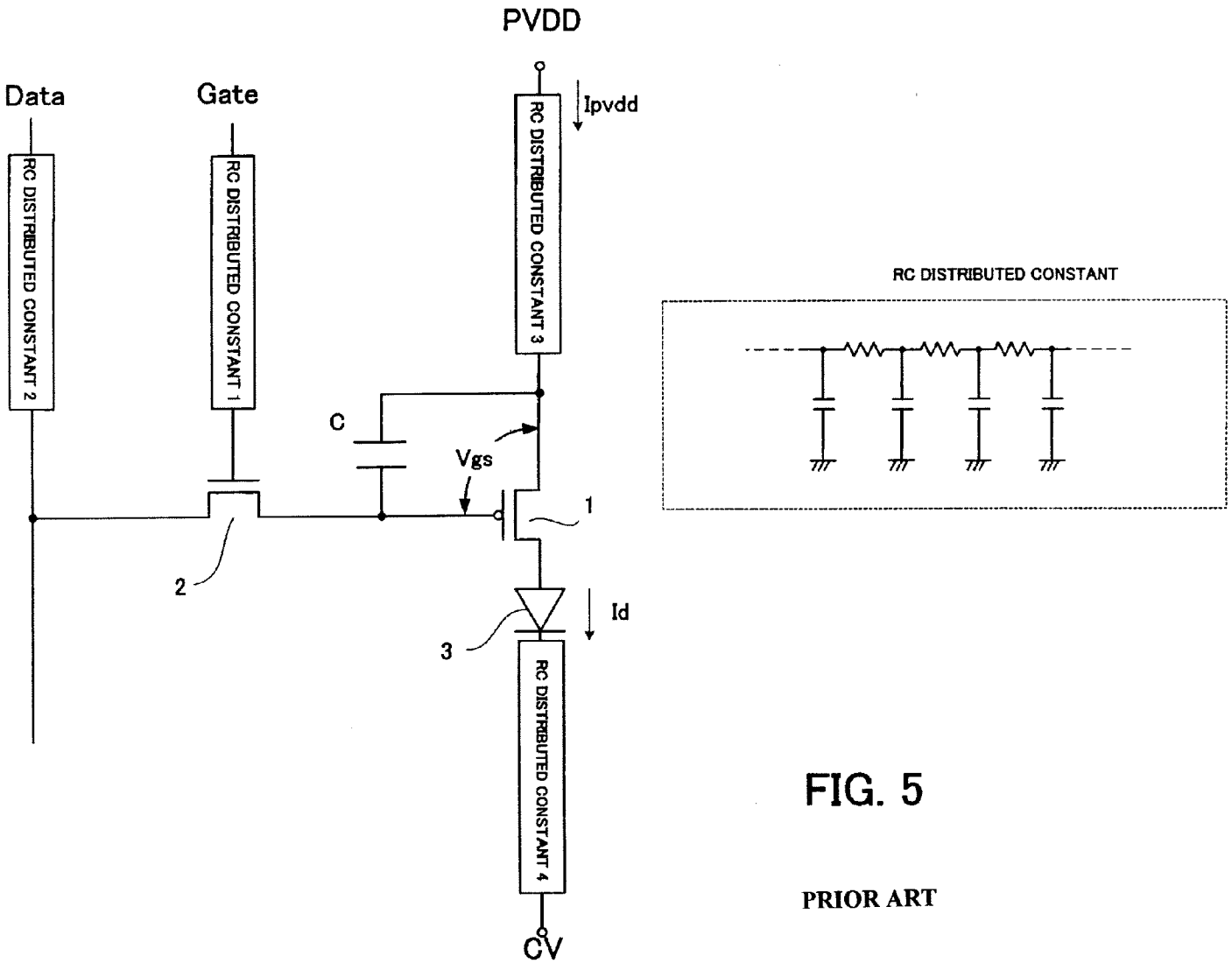
FIG. 5 PRIOR ART
FIG. 5 is a drawing showing positions where RC distributed constant circuits exist.
Figure 6:
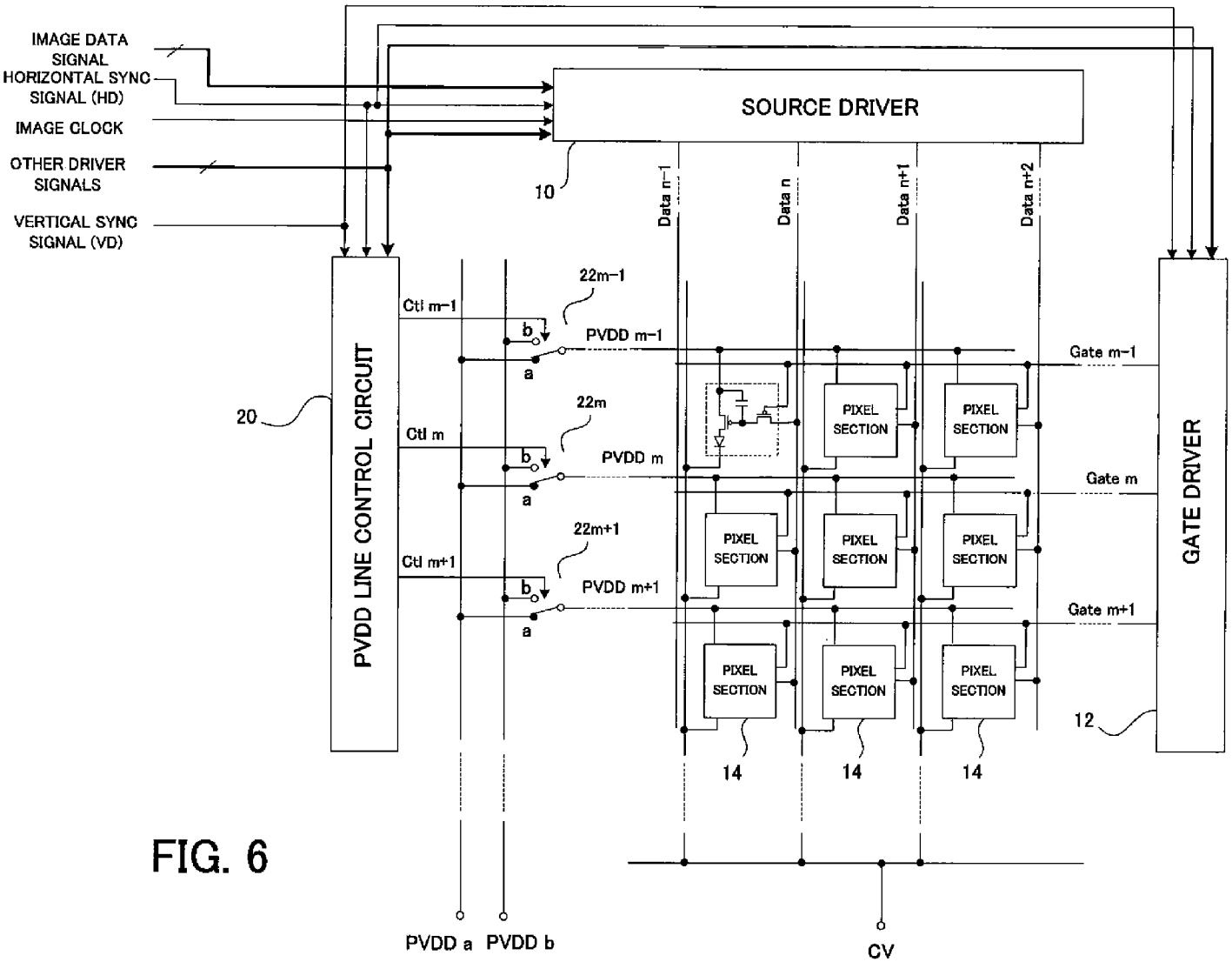
FIG. 6 is a drawing showing the structure for power supply switching of horizontal power supply lines.
Figure 7:
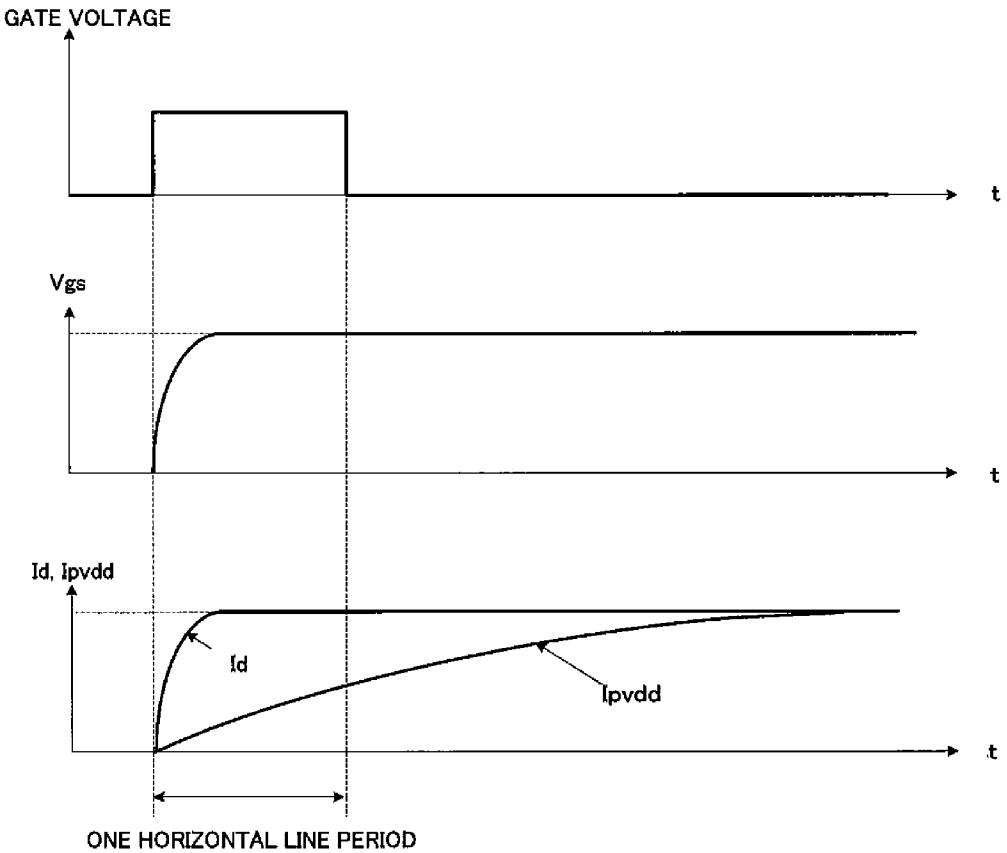
FIG. 7 is a drawing showing a relationship between current flowing in a drive TFT and the pixel current flowing in a power supply.

As shown in FIG. 6, this embodiment also has a source driver 10, a gate driver 12, and a pixel section 14 arranged in a matrix shape. Also, gate lines Gate extends from the gate driver 12 to each row. With this example, a P-channel transistor has been used as the select TFT 2, and is turned on when Gate is at an L level.

This embodiment has a PVDD line control circuit 20. A horizontal sync signal (HD), a vertical sync signal (VD) and other drive signals are supplied to this PVDD line control circuit. Horizontal PVDD lines are also provided along each pixel line, and each horizontal PVDD line is switchably connected to a vertical PVDDa line or a vertical PVDDb line by respective switches 22. The vertical PVDDa lines and vertical PVDDb lines are connected to respectively separate power supplies PVDDa and PVDDb. In FIG. 6, three horizontal PVDD lines, PVDDm−1, PVDDm and PVDDm+1, and three switches 22*m*−1, 22*m* and 22*m*+1 are shown.

In FIG. 6, the switch 22*m* is normally set to the a side so that power is supplied from power supply PVDDa to the horizontal PVDDm line. Although not shown in the drawing, the switch 22 is controlled so that when writing data a corresponding switch 22 is switched to the b side to supply power from the power supply PVDDb to a line that has been selected by a gate select line Gate.

Figure 8:
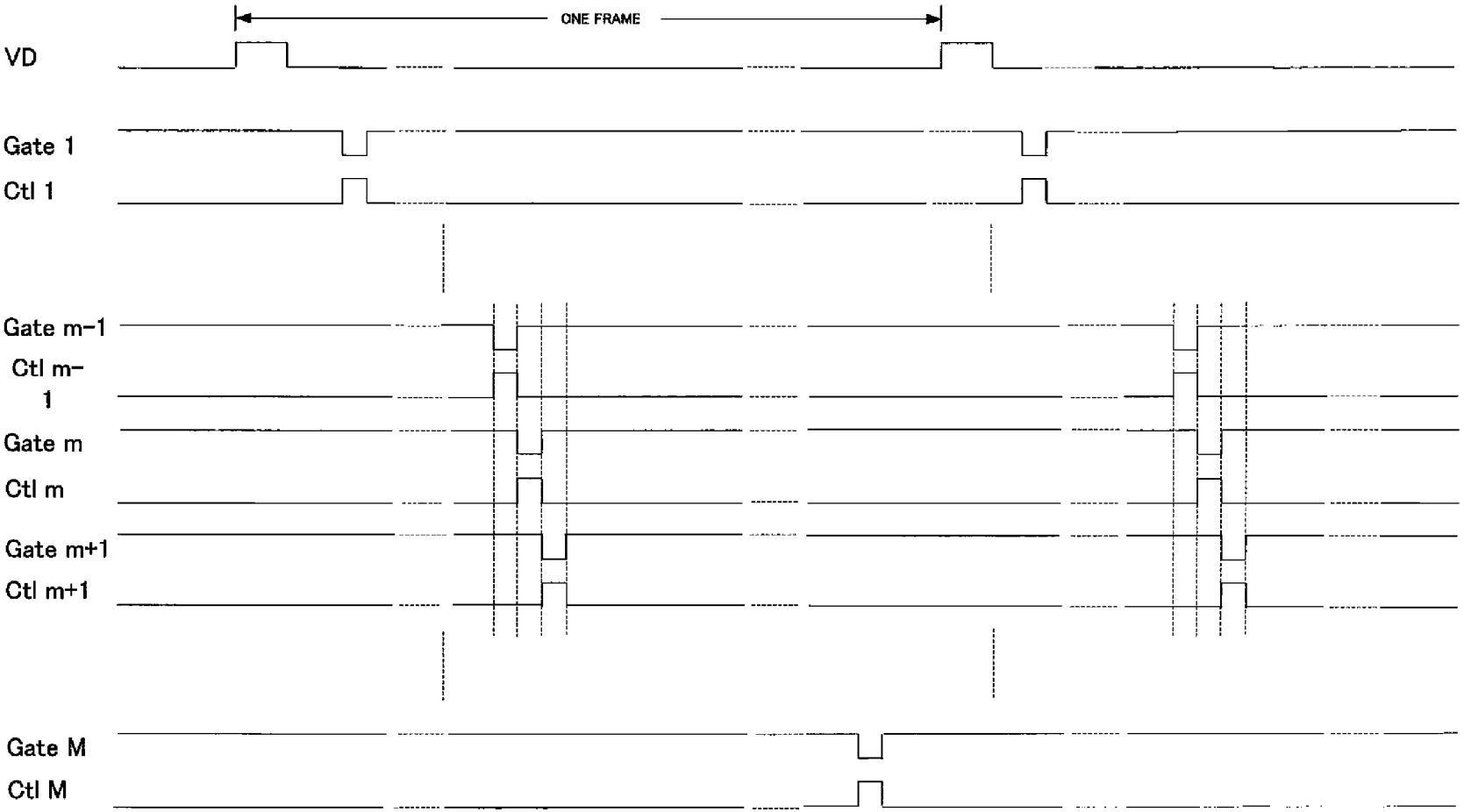
FIG. 8 is a timing chart of control lines for controlling gate lines and switches.

FIG. 8 is shows timing for controlling the switches 22, in a panel having M horizontal lines. A current measurement circuit is connected to the vertical PVDDb line, and current flowing in the PVDDb line at the time of writing measurement pixel data is measured. Measurement of pixel current utilizes a period within the horizontal period that is before writing of display pixel data.

As shown in the drawing, between successive rising edges of the vertical sync signal corresponds to one frame in which display for one screen or field is carried out. Within a single frame period, each of the gate lines Gate are sequentially activated (set to L level) one at a time. This ON period corresponds to one horizontal period. When one gate line Gate is at the L level, a control signal Ct1 that will switch the switch 22*b*, that is connected to the horizontal PVDD line of that line, to the b side is set to H level, the switch 22*b* is connected to the b side, and power supply PVDDb is supplied to the horizontal power supply line PVDD. At this time, the other switches 22 are all kept at the L level, and power supply PVDDa is supplied to all of the other horizontal PVDD lines for the lines that are not performing data write.

Figure 9:
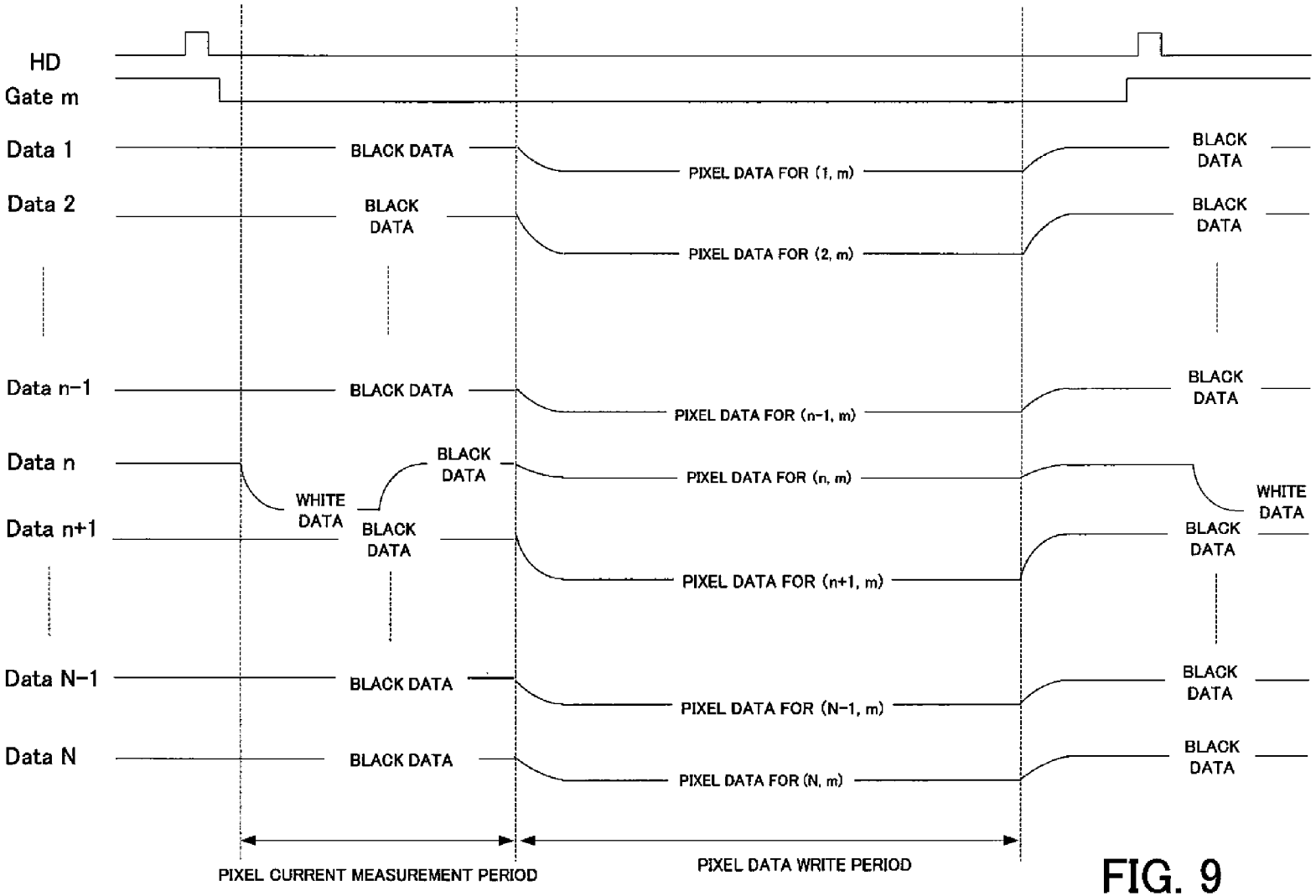
FIG. 9 is a drawing showing timing for pixel current measurement.

An example of write timing for the writing of display pixel data and current measurement pixel data for the horizontal line (line m) that has been selected by the gate select line, for the panel of FIG. 6, is shown in FIG. 9. In this way, the $m^{th}$ gate line Gatem becomes L level when writing pixel data of the corresponding line, and the TFT 2 of the appropriate line is turned on. In this state, by placing pixel data of the corresponding pixel onto the data line Data of each column, each pixel data is written to the corresponding pixel. Here, in this embodiment, before placing pixel data on the data line Data for each column within one horizontal period, white data is supplied for just a specified period to only the data line for the pixel to be measured. In this case, white data is supplied for about half a period of the image current measurement period before the image data write period, and after that is restored to black data. As a result, it is possible to measure both the current flowing in the vertical PVDDb line when white data has been supplied to one pixel, and current flowing in the vertical PVDDb line when all black data is supplied. In a period when image current is measured by applying white data, that pixel is momentarily lit, but the lighting period is extremely short which shows that it can be disregarded visually. Data supplied for current measurement is not limited to data equivalent to white, and it is possible to supply arbitrary data, and measure the current flowing at that time.

Figure 10:
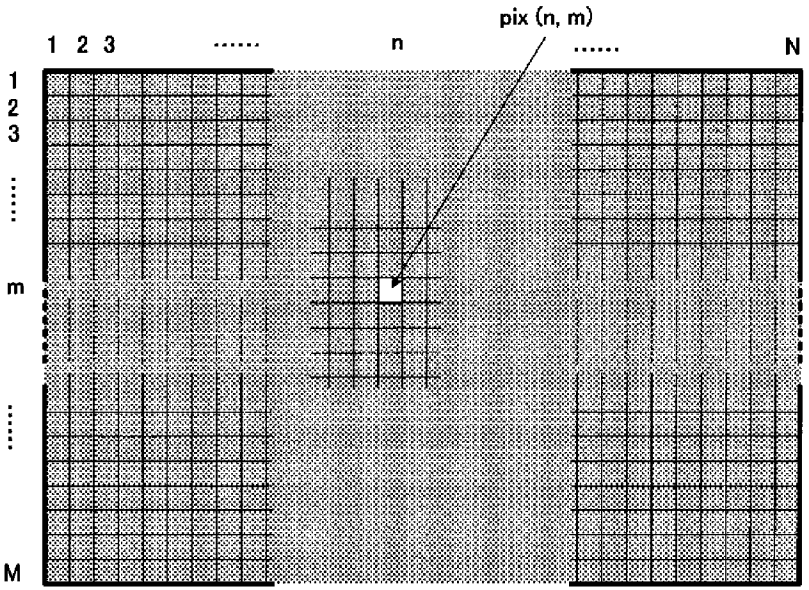
FIG. 10 is a drawing for describing pixel position in a display region.

When the location of each pixel is as shown in FIG. 10, pixel current is sequentially measured first from pix(1,1) to pix(1,M), and after completion advances to measurement of the second column of pixels. If the first column is finished, the second column is changed to and measurement similarly carried out. This is repeated up to the $M^{th}$ column, to complete current measurement for all pixels. According to this method, since it is possible to measure pixel current for one column of pixels in one frame, a time T is required for measurement of all pixels of a panel having horizontal pixels numbering N. This is T=N×Tf (Tf is frame period). For example, with a panel of horizontal pixels N=960 and frame period Tf=16 msec, the time required is 15.36 sec.

Figure 15:
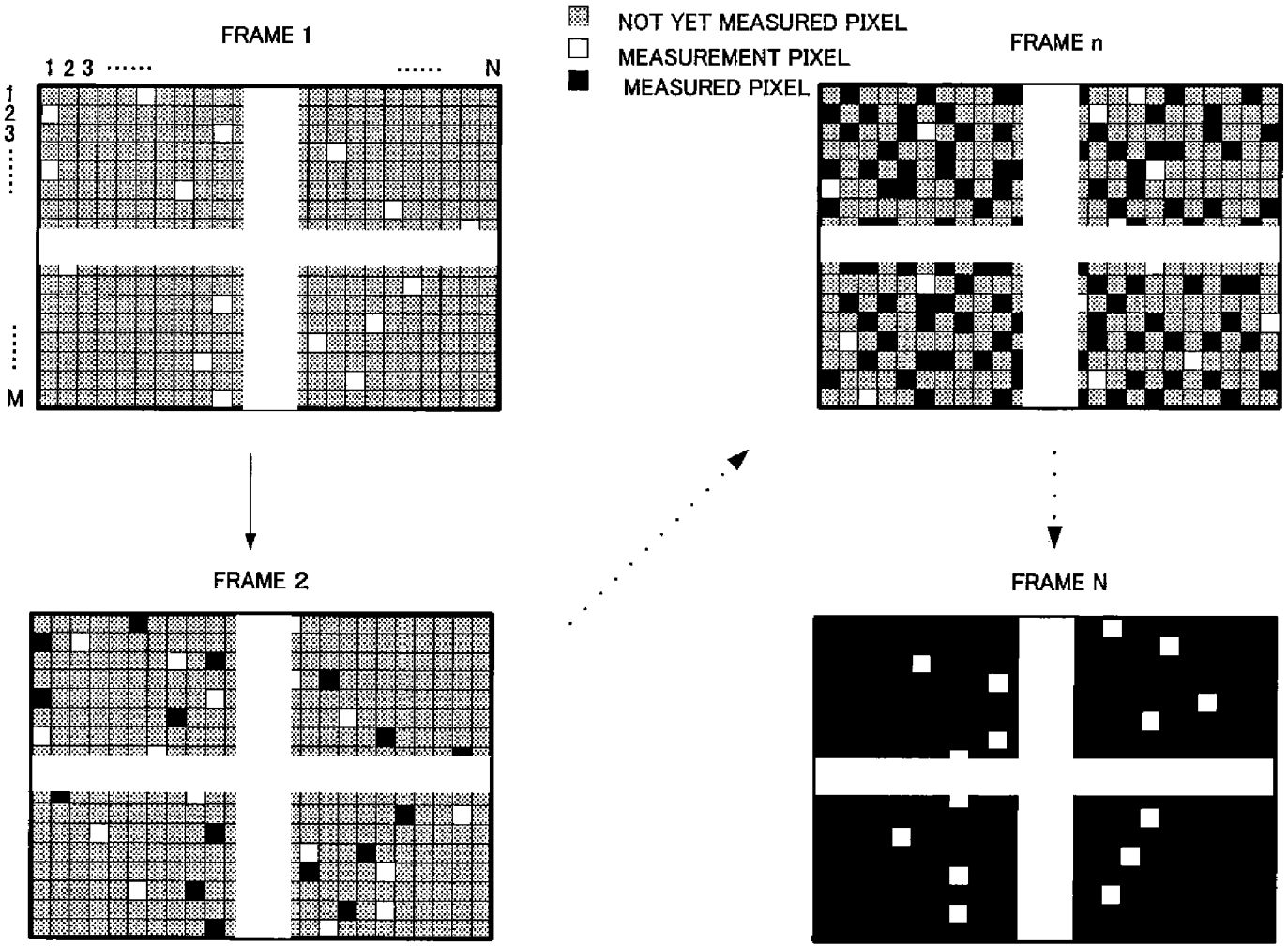
FIG. 15 is a drawing showing states for randomly selecting pixels for measuring pixel current.

If the surrounding temperature and brightness are varied, there will be changes in the characteristics of the TFT and the organic EL element. With a panel having a lot of pixels, a few minutes could be required for measurement, and there can be situations where the environmental conditions vary during this time, which will affect the measurement results. As described above, if measurement advances from the vertical line at the left end of the panel to the vertical line at the right end of the panel to correct irregularities, it is likely that correction errors due to the variation in environmental conditions will be formed into a pattern and become conspicuous. By measuring pixels at random pixels for every horizontal line, it becomes difficult to perceive this type of irregularity. Specifically, as shown in FIG. 15, the position in the horizontal direction of pixels measured for every single horizontal line becomes random for every horizontal line, and for every frame pixels at random positions, among the pixels that have not yet been measured, are measured. Therefore the correction errors are dispersed over the entire panel and are less conspicuous. This method can also be adopted in cases where current for each pixel is measured when the display device is not being used, and irregularity correction data is changed.

With a circuit structure of this example, the cathodes of the organic EL elements of all pixels are common, but there is a resistive component in the cathode terminal, and if the total current of pixels during display changes the cathode potential will fluctuate slightly. As a result, there are cases where the potential across PVDD of a pixel and the cathode of the organic EL element changes during display, so pixel current varies. Accordingly, during the pixel current measurement period it is preferable to have all pixels of other horizontal lines off. After turning the pixels off, it is necessary to once more light them up according to a data voltage read previously, so it is preferable to operate the PVDD power supply so there is no variation in the voltage value being charged to the storage capacitor. The average brightness of the panel becomes the display period/(display period+turned off period), compared to the case where pixels are not lit, which shows that it is necessary to raise the display brightness to the reciprocal of this (display period+turned off period/display period) in order to keep the same average brightness.

Figure 11:
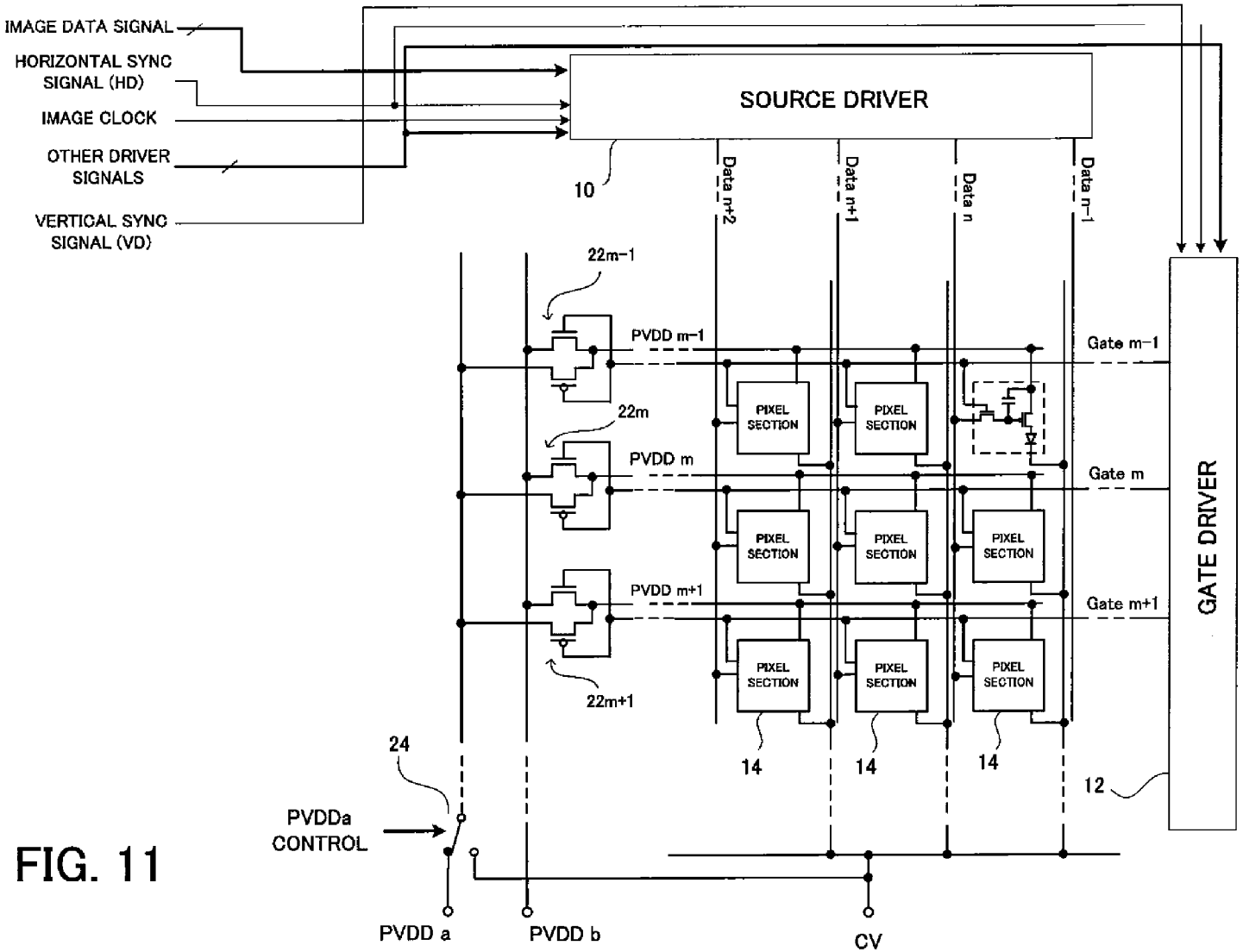
FIG. 11 is a drawing showing the structure for power supply switching of horizontal power supply lines.

FIG. 11 is an example where opening and closing of switches of horizontal PVDD lines to which pixels being written to belong are controlled by a gate select signal. Specifically, the switch 22 is made up of an n-channel TFT and a p-channel TFT, and connects the horizontal PVDD line to the vertical PVDDa line using the p-channel TFT that is turned on when the gate line Gate is at L level, and connects the horizontal PVDD line to the vertical PVDDb line using the n-channel TFT that is turned on when the gate line Gate is H level.

Also, with this example, for the above describe reasons, in the pixel current measurement period, the PVDD power supply for other horizontal lines is connected to the CV power supply. Specifically, in the pixel current measurement period the vertical PVDDa line is connected to the power supply CV by the switch 24. Accordingly, the horizontal PVDD lines that are not performing pixel writing are all unlit with the power supply lowered, and after that return to normal display.

Figure 12:
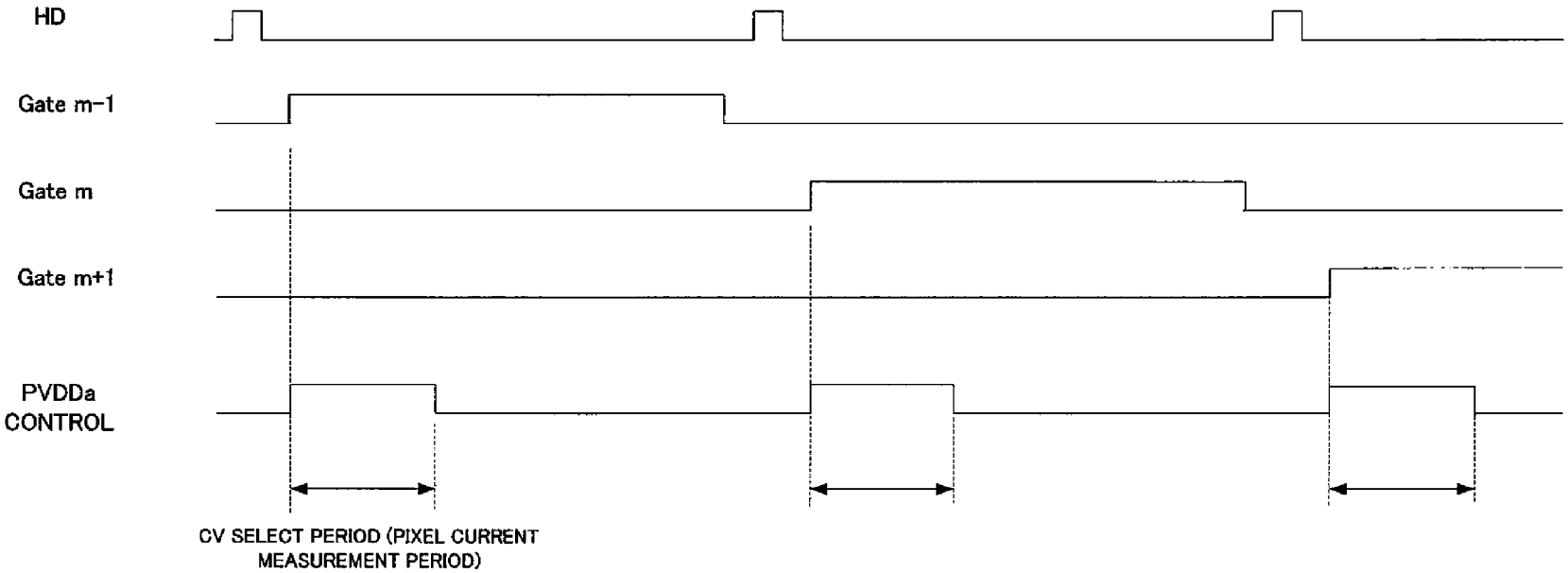
FIG. 12 is a drawing showing a CV selection period (pixel current measurement period)

In this case, the sum total of pixel currents for lines that are not performing image data writing preferably has little effect on the current measurement for pixels that are the subject of measurement, and if that condition is satisfied the point of connection to the vertical PVDDa line can be a higher voltage than the CV voltage. A drive timing chart is shown in FIG. 12. In this way a CV select period is provided corresponding to the pixel current measurement period, and in this CV select period horizontal PVDD lines besides the horizontal PVDD line of the horizontal line for detecting image current by writing white data are connected to power supply CV by the switch 24.

Figure 13:
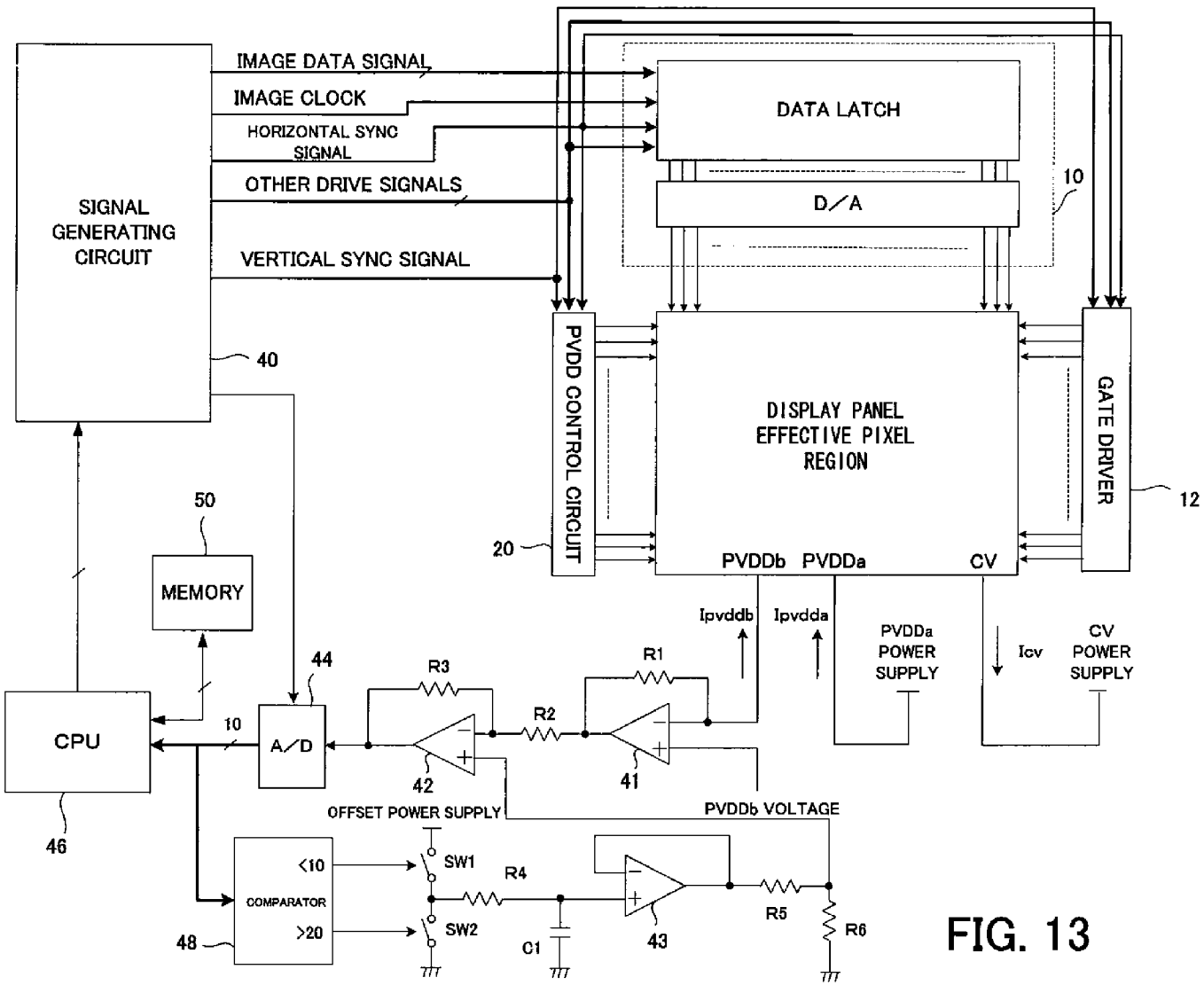
FIG. 13 is a drawing showing circuit for pixel current measurement.

One example of a circuit structure at the time of pixel current measurement is shown in FIG. 13. A signal generating circuit 40 generates image data and control signals (pixel clock, horizontal sync signal, vertical sync signal, and other drive signals) for performing the previously described drive in accordance with instructions of the CPU 46. Similarly to the case described above, the image data, pixel clock, horizontal sync signal, vertical sync signal and other drive signals are supplied to the source driver 10, and the horizontal sync signal vertical signal and other drive signals are supplied to the gate driver 12. Also, the horizontal sync signal, vertical sync signal and other drive signals are supplied to the PVDD line control circuit 20.

Also, the CV terminal of the display panel is connected to the CV power supply, and the PVDDa terminal is connected to the PVDDa power supply.

The PVDDb terminal of the panel is connected to the inverting input of an op-amp 41, while the non-inverting input is supplied with the PVDDb voltage. Also, pixel current Ipvddb is supplied from the PVDDb terminal, and a feedback resistance R1 is arranged between the inverting input and the output. As a result, a voltage of (PVDDb+Ipvddb×R1) is output to the output terminal of the op-amp 41.

The output of the op-amp 41 is input via a resistor R2 to the inverting input terminal of op-amp 42, a feedback resistor R3 is arranged between the output terminal and inverting input terminal of the op-amp 42, and a specified feedback voltage value that will be described later is supplied to the non-inverting input terminal. The gain of the op-amp 42 is therefore determined by the resistors R2 and R3. The resistance values of resistors R2 and R3 are set so as to give an optimum amplitude for input to an A/D converter 44, at a subsequent stage.

Figure 14:
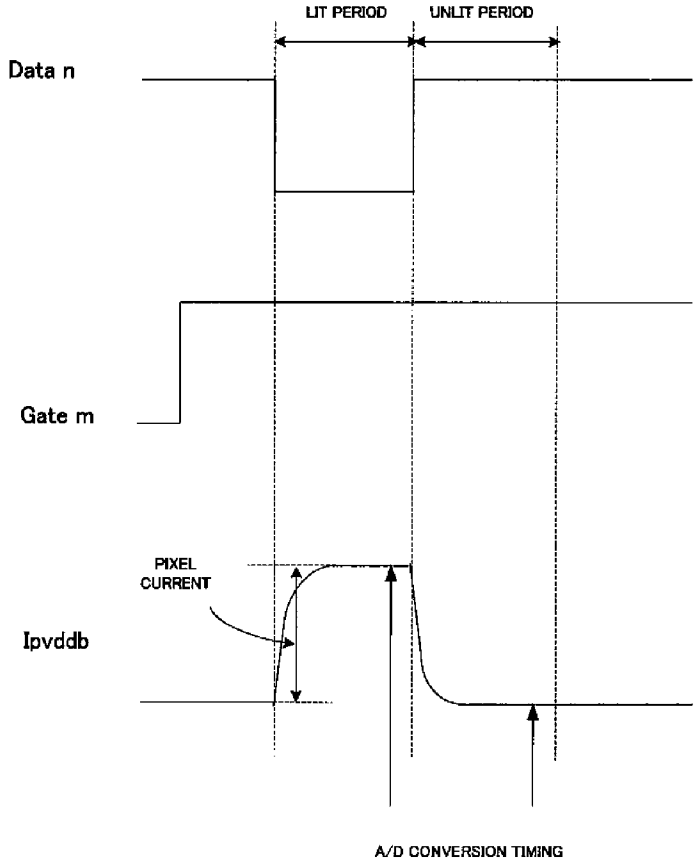
FIG. 14 is a drawing showing timing for A/D conversion.

Output of the A/D converter 44 is supplied to the CPU 46. Here, A/D conversion in the A/D converter 44 is carried out in the pixel current measurement period shown in FIG. 9, a difference between current values when pixel current flows (lit period) and when current is stopped (off period) is calculated by the CPU 46, and this result is made the pixel current for the appropriate pixel. In this way, it is possible eliminate a noise component having a long period compared to these sampling intervals. Also in this case, it is possible to perform A/D conversion at a time when the current becomes sufficiently stable, as shown in FIG. 14.

Also, since current for a single pixel is in the μA order or less, the total gain up to the A/D converter 44 is extremely high, and a DC level of the output of the op-amp 42 becomes extremely unstable. Accordingly, based on the A/D output value at the off time, a bias voltage is fed back to the op-amp 42, to perform control so that the lit time voltage and the off time voltage is input within an input range of the A/D converter 44.

With this example, the output of the A/D converter 44 is 10-bits, and this is input to a comparator 48. The comparator 48 compares the off time output value of the A/D converter 44 with 10, and if it is smaller that 10 closes a switch SW1. In this way, an offset power supply is supplied via a resistor R4 to one end of a condenser C1 that has another end connected to ground, and the condenser is charged. The charged voltage of this condenser C1 is supplied to the non-inverting terminal of an op-amp 43. This op-amp 43 has the output terminal and the inverting input terminal short-circuited, and the charged voltage of the condenser C1 is stabilized and output. The output of the op-amp 43 is connected via resistors R5 and R6 to ground, and the connection point of the resistors R5 and R6 is supplied to the non-inverting terminal of the op-amp 42.

Therefore, SW1 is turned on to supply charge current to the condenser C, and if this voltage become high a bias voltage supplied to the non-inverting input terminal of the op-amp 42 is raised.

Also, when the output value at the off time is larger than 20, the comparator 48 closes the switch SW2. In this way, one end of the condenser C1 is connected via the resistor R4 to ground, and the charge voltage of the condenser C1 is reduced. As a result, the bias voltage of the op-amp 42 is lowered. Also, when the offtime output value is between 10 and 20, since SW1 and SW2 are open the voltage of the condenser C1 is held as it is, and the bias voltage of the op-amp 42 is maintained. In order to avoid the effects of noise due to turning the switches on and off, it is preferable to turn the switches SW1 and SW2 on and off intermittently, such as in a horizontal blanking period, vertical blanking period etc., and to have the SW1 and SW2 off outside the blanking periods. Also, response speed is determined by the period SW1 and SW2 are on, and a time constant of C1×R4, but the effects on measurement accuracy will be smaller if speeded up as much as possible within the required range.

In doing this, according to the structure of FIG. 13, since feedback control is carried out so as to keep output of the A/D converter 44 within a specified range (with this example, 10-20) for pixel current at the off time, then even if the pixel current at the off time varies, it is possible to carry out comparison with the on-time current comparatively accurately in that state.

Figure 16:
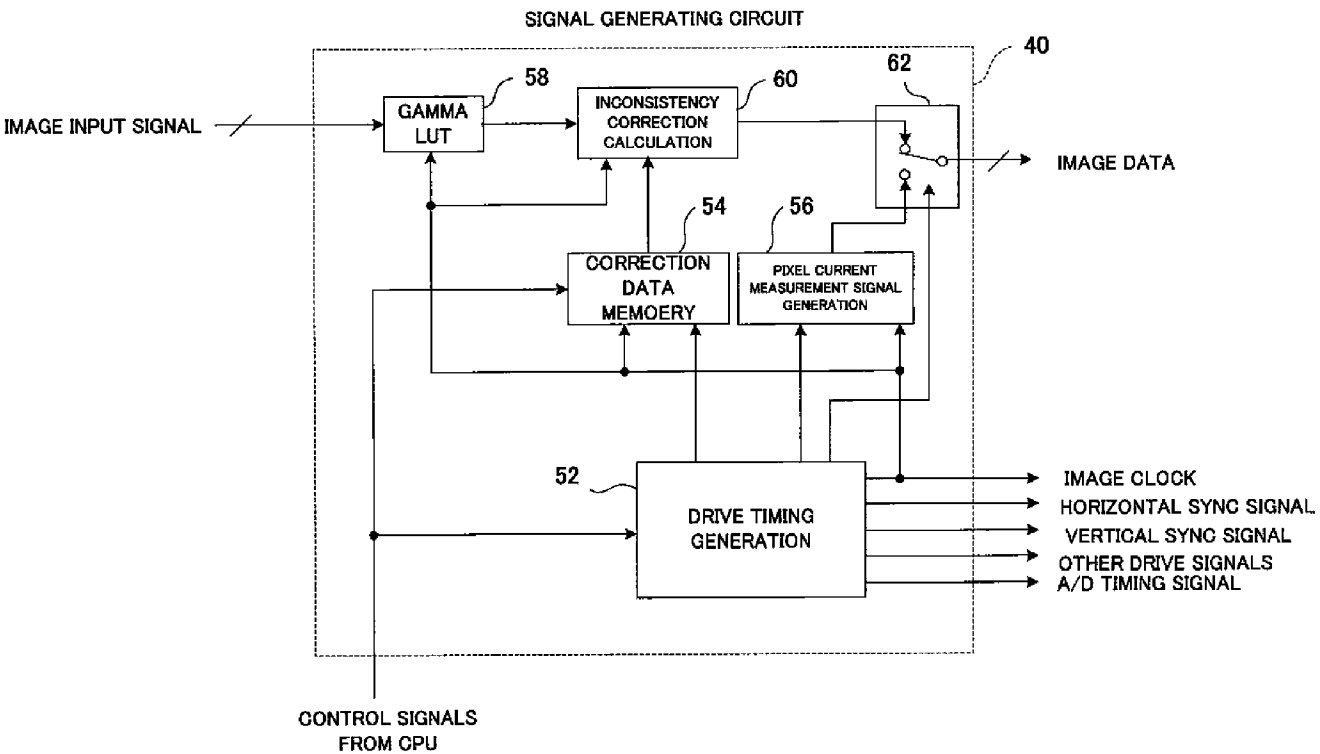
FIG. 16 is a drawing showing a structural example of a signal generating circuit.

A memory 50 is connected to the CPU 46, with pixel current for each pixel section 14 being stored in this memory 50, and based on this data the CPU 46 calculates new correction data for each pixel, and updates data of a correction memory that resides inside the signal generating circuit. Display image data is subjected to correction as shown in FIG. 16 using this correction data.

Specifically, in this embodiment there is the signal generating circuit 40. Control signals from the CPU 46 are supplied to the drive timing generating section 52. The drive timing generating section 52 generates and outputs a pixel clock, horizontal sync signal, vertical sync signal, other drive signals and A/D timing signals. Accordingly, the outputs from the drive timing generating section 52 are supplied to the source driver 10, gate driver 12 etc. The pixel clock, horizontal sync signal, vertical sync signal etc. are signals that are synchronized to the image input signal.

Also, new correction data for each pixel that has been calculated by the CPU 46 is written to the correction memory 54, and this data is updated. Further, a pixel current measurement signal generating section 56 is provided in the signal generating circuit 40, and this pixel current measurement signal generating section 56 generates image data to be supplied to the pixels at the time of pixel current measurement.

The image input signal is subjected to gamma correction in a gamma LUT 58, and after that is supplied to the irregularity correction calculation section 60. This irregularity correction calculation section 60 carries out irregularity correction in accordance with correction data supplied from the correction data memory 54, for the pixel signal of each pixel. Data after irregularity correction is then supplied via the switch 62 to the source driver 10 as image data. The switch 62 selects signals from the pixel current measurement signal generating section at the time of pixel current measurement, using signals from the drive timing generating section 52. Accordingly, the above-described pixel current measurement is carried out based on pixel data from the pixel current measurement signal generating section.

In this manner display is normally carried out using image data that has been corrected, and it is possible to effectively reduce the occurrence of display irregularities. It is possible for pixel current measurement and updating of data in the correction data memory to be carried out constantly, or it can be carried out periodically.

The invention has been described in detail with particular reference to certain preferred embodiments thereof, but it will be understood that variations and modifications can be effected within the spirit and scope of the invention.

PARTS LIST

| | |
|---|---|
| 1 | drive TFT |
| 2 | select TFT |
| 3 | organic EL element |
| 10 | source driver |
| 12 | gate driver |
| 14 | pixel selection |
| 20 | control circuit |
| 22m − 1 | switch |
| 22 | switches |
| 22b | switch |
| 22m | switch |
| 22m + 1 | switch |
| 40 | signal generating circuit |
| 41 | op-amp |
| 42 | op-amp |
| 43 | op-amp |
| 44 | A/D converter |
| 46 | CPU |
| 48 | comparator |
| 50 | memory |
| 52 | generating section |
| 54 | memory |

-continued

| PARTS LIST | |
|---|---|
| 56 | generating section |
| 58 | LUT |
| 60 | calculation section |
| 62 | switch |
| C1 | condenser |
| R1 | resistor |
| R2 | resistor |
| R3 | resistor |
| R4 | resistor |
| R5 | resistor |
| R6 | resistor |
| SW1 | switch |
| SW2 | switch |

The invention claimed is:

1. A display device for correcting brightness inconsistencies among a plurality of pixels, comprising:

(a) an active matrix organic EL display panel having the plurality of pixels arranged in a matrix, the matrix comprising a plurality of horizontal lines of pixels and a plurality of vertical lines of pixels;

(b) a plurality of power supply lines for supplying power to pixels in the corresponding horizontal lines;

(c) a plurality of gate lines for controlling write to pixels in the corresponding horizontal lines;

(d) first means for selecting a pixel and the gate line connected to the selected pixel;

(e) a gate driver for activating the selected gate line to enable write to the selected pixel;

(f) a plurality of data lines for supplying data to pixels in the corresponding vertical lines;

(g) a source driver for providing pixel data to the plurality of data lines, wherein the source driver writes measurement pixel data to the selected pixel in the selected row and black data to all other pixels in the selected row;

(h) a first and a second power supply;

(i) a plurality of first switches for switchably connecting the corresponding power supply lines to either the first or the second power supply;

(j) a current measurement circuit for measuring a respective first current corresponding to the selected pixel and flowing in the second power supply when measurement pixel data is written to the selected pixel;

(k) a line control circuit for controlling the first switches, wherein the line control circuit causes the power supply line corresponding to the selected gate line to be connected to the second power supply, and all other power supply lines to be connected to the first supply;

(l) a signal generating circuit for controlling the line control circuit, gate driver and source driver to measure the current of the selected pixel;

(m) second means for selecting each of the plurality of pixels in a selected first order to measure the respective first current corresponding to each of the plurality of pixels;

(n) third means for receiving a respective input image signal corresponding to each pixel and calculating respective corrected image data for each pixel using the respective first current corresponding to each pixel; and (o) fourth means for supplying the corrected image data to each pixel to correct brightness inconsistencies among the plurality of pixels.

2. The display device of claim 1, wherein the selected gate line is activated for a horizontal period comprising a current measurement period and an image data write period, and wherein measurement pixel data is written to the selected pixel during a current measurement period and corresponding image data is written to the selected pixel during an image data write period.

3. The display device of claim 2, wherein during the current measurement period black data is written to all pixels in the selected row except the selected pixel, and during the image data write period corresponding image data is written to all pixels in the selected row except the selected pixel.

4. The display device of claim 1, further comprising a third power supply and a second switch, wherein the line control circuit causes all power supply lines except the selected power supply line to be connected through the second switch to the third power supply while measuring a first current and to be connected through the second switch to the first power supply at all other times.

5. The display device of claim 1, wherein the pixels are selected sequentially down a selected column.

6. The display device of claim 5, wherein the selected columns are selected sequentially across the display panel.

7. The display device of claim 1, further comprising means for selecting the first order such that pixels are measured at random positions within each horizontal line.

8. The display device of claim 2, wherein the current measurement period comprises a lit period and an off period, wherein measurement pixel data is written to the selected pixel during the lit period and black data is written to the selected pixel during the off period, wherein the current measurement circuit further measures a respective second current corresponding to the selected pixel and flowing in the second power supply during the off period, and wherein the third means further uses the respective second current to calculate the respective corrected image data corresponding to each pixel.

9. The display device of claim 8, further comprising:

(p) an A/D converter for providing to the third means a respective first digital output representing the first current corresponding to the selected pixel and a respective second digital output representing the second current corresponding to the selected pixel;

(q) a first op-amp for providing an op-amp output to the A/D converter; and (r) fifth means for providing a bias voltage to the first op-amp, wherein the bias voltage is controlled to maintain each of the respective second digital outputs within a selected range.

10. The display device of claim 8, wherein the pixel current is the difference between the first current and the second current values when a pixel is unlit and when a pixel is lit is calculated to give pixel current.

* * * * *